United States Patent [19]

Kashio

[11] 4,027,764

[45] June 7, 1977

[54] APPARATUS FOR CONFIRMING THE CORRECT IMPRESSION OF PRINTING CHARACTERS

[75] Inventor: Toshio Kashio, Tokyo, Japan

[73] Assignee: Casio Computer Co., Ltd., Tokyo, Japan

[22] Filed: June 22, 1976

[21] Appl. No.: 698,313

[30] Foreign Application Priority Data

June 24, 1975 Japan ..... 50-77871
Aug. 11, 1975 Japan ..... 50-97349

[52] U.S. Cl. ..... 197/49; 235/153 AS; 197/19; 101/93.15; 197/82

[51] Int. Cl.[2] ..... B41J 1/04

[58] Field of Search ... 101/110, 93.09, 93.15–93.17, 101/93.21, 93.22, 93.28–93.34; 197/17, 19–20, 82, 48–49; 235/60 P, 153 AS

[56] References Cited

UNITED STATES PATENTS

| | | | |
|---|---|---|---|
| 3,374,873 | 3/1968 | Takenaka | 197/49 |
| 3,599,772 | 8/1971 | Comstock | 101/93 X |
| 3,630,335 | 12/1971 | Chamness | 197/49 |
| 3,710,912 | 1/1973 | Bretti et al. | 101/93 X |
| 3,795,300 | 3/1974 | Matsuzawa | 197/49 |
| 3,957,151 | 5/1976 | Kashio | 101/93.18 X |

*Primary Examiner*—Edward M. Coven

*Attorney, Agent, or Firm*—Flynn & Frishauf

[57] ABSTRACT

An apparatus for confirming the correct impression of printing characters wherein any of the characters arranged in at least one line circumferentially extending on the peripheral surface of a cylindrical printing drum is designated by controlling the operation of the printing drum to be brought to a prescribed printing position on the surface of the recording medium for printing and the printing drum can be moved in the axial direction, and which comprises a detector for detecting a circumferential angle defined by the position of the selected one of said linearly arranged characters with a point of referential angle provided on the rotating printing drum; a counter for counting signals denoting the steps of the rotation of said printing drum required for said selected character to take a desired printing position; and a comparison circuit for comparing a number of rotation steps required for the printing drum to return to the point of a referential angle after impression of one line of characters on a recording medium is brought to an end and a number of rotation steps required for the printing drum to run through a circumferential angle defined by the position of the terminal character of the respective lines impressed on the recording medium with the referential angle point, thereby finding an error, if any, occurring in impressing the respective lines on the recording medium.

6 Claims, 5 Drawing Figures

APPARATUS FOR CONFIRMING THE CORRECT IMPRESSION OF PRINTING CHARACTERS

BACKGROUND OF THE INVENTION

This invention relates to a printing device having a plurality of characters arranged in at least one line circumferentially extending on the peripheral surface of a printing drum, and more particularly the type additionally provided with an apparatus for confirming the correct impression of printing characters which can recognize a coincidence between printing input data and any character actually impressed on a recording medium.

A drum type printing device wherein printing characters are circumferentially arranged in a plurality of lines at a prescribed peripheral interval impresses desired characters successively on a recording medium by selecting the angle through which the printing drum is rotated.

The printing drum is coupled with a pulse motor driven to an extent corresponding to the selected rotation angle of the printing drum. Control of the rotation steps of the pulse motor is effected by calculating a number of the rotation steps of the printing drum required to bring printing characters corresponding to input data supplied by manual operation or, previously preset in a memory or transferred signals of printing characters to a prescribed printing position and stepwise driving the pulse motor in accordance with the calculated rotation steps. Where, with the prior art printing device, a signal denoting, for example, a printing character "B" corresponding to a rotation angle II of the printing drum is supplied after impression of, for example, a printing character "A" corresponding to a rotation angle I of the printing drum, then comparison is made between the rotation angle II of the printing drum relative to the character B being impressed next time and the rotation angle I of the printing drum corresponding to the previously impressed character A. The pulse motor is driven by a number of step signals required for the printing drum to be rotated to an extent corresponding to a difference between the above-mentioned rotation angles II and I, thereby bringing the character "B" type to a printing position.

Namely, a step signal for causing the pulse motor to be driven in a sufficient number of steps to bring a desired character type provided on the printing drum to a printing position is issued, each time said pulse motor is supplied with a signal denoting a desired printing character. Said step signal controls the rotation of the pulse motor, thereby determining the rotation angle of the printing drum. With the above-mentioned conventional drum type printing device, the printing drum is rotated in accordance with the above-mentioned step signal, effectively carrying out high speed impression and rendering said printing device very useful as an output device for an electronic computer.

With the prior art printing device, however, the printing drum 1 is rotated at each time of impression to an extent corresponding to a difference between a rotation angle relative to the preceding character and that corresponding to the succeeding character without being brought back to the prescribed point of 0° reference angle.

Where, therefore, noncoincidence occurs between a step signal and an actual amount of rotation of the pulse motor for rotating the printing drum due to, for example, mechanical slips or absence of signals, then characters subsequently impressed on a recording medium do not match input character signals. Particularly where printing input data consists of for example, a series of numerals, notations, or combinations thereof, a mere look at an impression on a recording medium fails to find printing errors if any. In such case, the impression becomes little reliable.

With the drum type printing device, printing characters on the drum are selected not only by the rotation of the drum but also by its axial movement. The axial movement of the drum is carried out by a step signal instructing comparison between a number of steps by which the previously impressed character line is spaced from the rear side of the printing drum and a number of steps by which a new character line being impressed is spaced from the rear side of the printing drum and also the advance of a printing hammer. When new printing input data is supplied, the above mentioned comparison is made by, for example, a matrix circuit, issuing a signal denoting the result of comparison, or a balance arrived at by subtraction between the above-mentioned two numbers of steps, that is, an extent to which the printing drum is required to move axially for impression of a new character line. This axial movement is effected by the pulse motor or ratchet mechanism. Therefore, a selected character is correctly impressed, as long as the printing drum is driven to an exactly desired extent. Where, however, non-coincidence occurs between a step signal issued and an actual amount of the printing drum due to, for example, mechanical slips, absence of signals and intrusion of noises, then all the subsequently selected character lines do not exactly correspond to input character data, failing to attain correct impression. Particularly where the above-mentioned prior art printing device is used as output means with, for example, an electronic computer, it is difficult quickly to recognize errors of impression. Where the impression consists of, for example, a series of numerals, notations or combinations thereof, a mere look at the impression fails to find errors.

SUMMARY OF THE INVENTION

It is accordingly the object of this invention to provide an apparatus for confirming the correct impression of printing characters which automatically detects coincidence or noncoincidence between input character data and a character actually impressed on a recording medium, thereby continuing printing while confirming the correct impression of printing characters.

To this end, this invention provides an apparatus for confirming the correct impression of printing characters which comprises means for presetting at least one point of referential angle with respect to the rotation of a printing drum; means for specifying the rotation steps of the printing drum in order to bring the selected one of the printing characters provided on the peripheral surface of the printing drum and spaces from said referential angle point by a certain circumferential angle to a required printing position on a recording medium; means for storing the specified rotation steps of the printing drum; means for detecting a difference between the specified rotation steps of the printing drum and a number of steps by which the printing drum is required to rotate in order to run through a circumferential angle defined by the position of a subsequently impressed character with said referential angle point;

means for controlling the rotation angles of the printing drum in succession in accordance with a detection output from the detecting means and also admitting of the progressive axial movement of the printing drum; and means for comparing a number of rotation steps required for the printing drum to be rotated back to the referential angle point after compression of one line on a recording medium is brought to an end and a number of steps required for the printing drum to run through a circumferential angle defined by the position of the terminal character of the respective lines impressed on the recording medium with said referential angle point, in order to find an error, if any, in the impression of the respective lines from the result of said comparison, and whereby the rotation angle of the printing drum is controlled by input character data, and examination is made to recognize coincidence or non-coincidence between the input character data and a character actually impressed on a recording medium during the printing operation, for example, each time impression of one line is brought to an end.

DETAILED DESCRIPTION OF THE PREFERRED EMBODIMENTS

One embodiment of this invention will be explained below by referring to the accompanying drawings.

Figure 1:
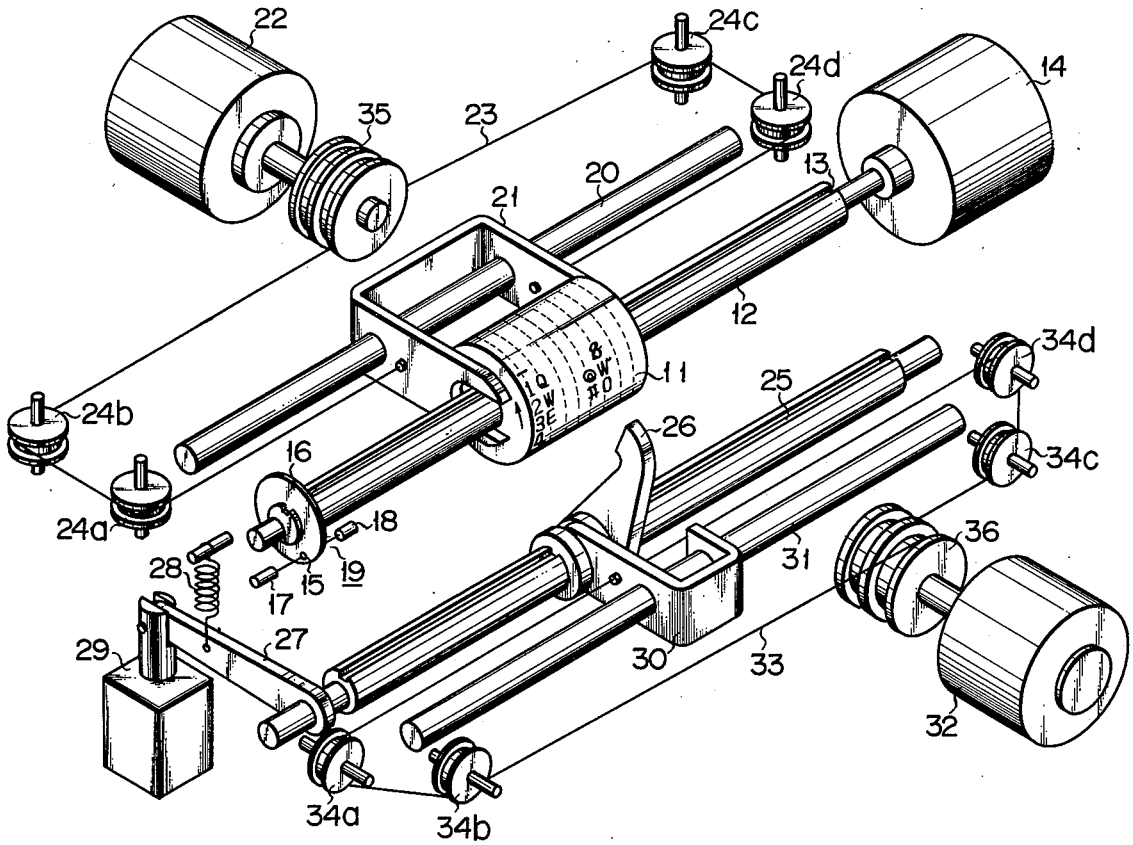
FIG. 1 is an oblique view of the main part of a printing device provided with an apparatus for confirming the correct impression of printing characters according to an embodiment of this invention.

FIG. 1 schematically shows part of a printing device. A plurality of groups of embossed characters are arranged on the outer peripheral surface of a printing drum 11 with the embossed characters in each group being located in a predetermined rotation angle or interval on the outer peripheral surface of the printing drum. The corresponding characters in each group are axially arranged on the outer peripheral surface of the printing drum to constitute a row of embossed characters. Any character to be printed is selected by the rotation angle position and axial moving position of the printing drum 11. The rotation drum 11 is mounted on a shaft 12 and the printing drum 11 and shaft 12 are rotated as a unit utilizing a key way 13. The printing drum 11 is free to be moved along the shaft 12. A pulse motor 12 is coupled to one end of the shaft 12 to control the rotation of a pulse motor 14. A rotating plate 16 with a through hole 15 is mounted on the other end portion of the shaft 12. A light source 17 is located in alignment with a light receiving element 18 so that the element can receive a light sent from the light source 17 through the through bore 15 of the rotating plate 15. In this way, a reference angle detector 19 for the printing drum 11 is provided. A guide rail 20 is disposed in parallel with the shaft 12. On the guide rail 20 is movably mounted a holding mechanism 21 adapted to set the axial moving direction of the printing drum 11. A string 23 is wound on a pulley 35 coaxially mounted on a pulse motor 22 and both the ends of the string 23 are mounted on the holding mechanism 21 respectively through paired pulleys **24*b*, 24*a* and 24*c*, 24*d*. The axial moving position of the printing drum 11 is controlled through the string 23 by the pulse motor 22**.

A hammer shaft 25 is disposed in parallel with the shaft 12 and a hammer 26 is mounted through a key way on the hammer shaft 25 so that the hammer 26 can be swung integrally with the hammer shaft 25, and the outer peripheral surface of the printing drum 11 is struck with the hammer 26 when the hammer shaft 25 is swung. A lever 27 is mounted on the hammer shaft 25 and the hammer 26 is urged by a spring 28 so that it can be moved away from the outer peripheral surface of the printing drum 11. The lever 27 is driven by an electromagnetic plunger 29 against the force of the spring 28 to cause the outer peripheral surface of the printing drum 11 to be struck with the hammer 26. The electromagnetic plunger 29 is excited by a printing instruction. The axial moving position of the hammer 26 is set by a holding mechanism 30. The holding mechanism 30 is mounted on a guide rail 31 which is disposed in parallel with the hammer shaft 25. A string 33 is wound on a pulley mounted on a pulse motor 32 and both the ends of the string 33 are tied to the holding mechanism 30 through paired rollers **34*b*, 34*a* and 34*c*, 34*d*. The holding mechanism 30 is moved by the pulse motor 32 along a hammer shaft 25. In this case, the pulse motor 32 is driven by a step printing instruction which is issued by any suitable means (not shown) after issuance of a printing instruction. This causes the hammer 26 to be moved stepwise an amount corresponding to one character on the printing drum 11. The hammer 26** is returned by a return instruction to an original position.

The angular rotation position and axial position are set by the pulse motors 14 and 22, respectively, and any character on the printing drum which is to be printed is caused to confront the hammer 26 by the driving control of the pulse motor 32 and is struck with the hammer 26 with a recording paper in between, thus printing a character output on the recording paper.

Figure 2:
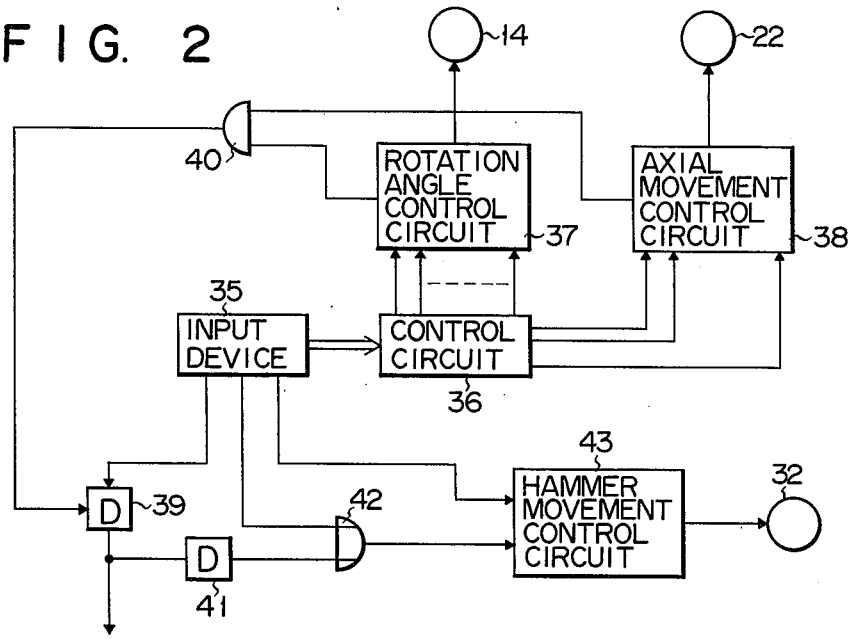
FIG. 2 is a block circuit diagram of a drive control circuit of the printing device of FIG. 1.

FIG. 2 shows a drive circuit of a printing device. A character signal corresponding to a character to be printed is drived by, for example, a manual operation from an input device 35. The character signal is coupled to a control circuit 36. In the control circuit 36 character position on the printing drum which corresponds to the character signal is determined using, for example, a matrix circuit etc., and instructions corresponding to the rotation angle position and axial position on the printing drum 11 are sent to a rotation angle control circuit 37 and axial moving control circuit 38, respectively, thereby causing the corresponding pulse motors 14 and 22 to be driven to permit the character on the printing drum which corresponds to the character signal to confront the hammer 26.

The input device 35 delivers a print instruction signal together with the above-mentioned printing character signal resulting from the inputting operation. The print instruction signal of the input device 35 is fed to a delay circuit 39. The delay circuit 39 consists of, for example, a delayed flip-flop circuit adapted to be controlled by a signal from an AND circuit 40 to which are coupled a rotation angle control complete signal from the rotation angle control circuit 37 and an axial movement control complete signal from the axial movement control circuit 38. Upon completion of the rotation angle and axial movement controls the delay circuit 39 delivers an output. The output of the delayed circuit 39 is supplied as a hammer drive signal to an electromagnetic plunger 29 and also through a delay circuit 41 and OR circuit 42 to a hammer control circuit 43 to cause the pulse motor 32 to be driven to permit the hammer 26 to be moved stepwise an amount corresponding to one character.

That is, when a print input is given to the input device 35, an instruction is issued as a character signal to the rotation angle control circuit 37 and axial movement control circuit 38 to cause the pulse motors 14 and 22 to be driven to permit a corresponding character on the printing drum 11 to confront the hammer 26. On the other hand, the outputs of the rotation angle control circuit 37 and axial movement control circuit 38 are coupled to the AND circuit 40. The output of the AND circuit 40 is fed to the delay circuit 39 where a print instruction signal is generated. The output of the delay circuit 39 is supplied to the electromagnetic plunger 29, causing the latter to be energized to permit the corresponding character on the printing drum 11 to be struck with the hammer 26 for printing.

Upon completion of the printing operation, the delay circuit 41 generates an output. The output of the OR circuit 42 is supplied through the OR circuit 42 to the hammer movement control circuit 43, causing the pulse motor 32 to be moved stepwise an amount corresponding to one character.

The angular rotation control circuit 37 generates a step signal corresponding to one character on the printing drum 11 and the axial movement control circuit 38 generates a step signal corresponding to a character row position on the printing drum 11. The pulse motors 14 and 22 are driven by the outputs of the rotation angle control circuit 37 and axial movement control circuit 38 and, in this case, the amount of rotation of the printing drum 11 and the amount of axial movement of the drum 11 are in proportion to the number of step signals.

A step signal corresponding to a space operation and a return instruction signal for returning the printing drum 11 to a head position on a recording medium are obtained from the input device 35. The step signal for the space operation is coupled through the OR circuit 42 to the hammer movement control circuit 43, controlling the rotation of the pulse motor 32 so that the hammer 26 is moved stepwise in amounts corresponding to one character on the printing drum 11 without involving any printing operation. The return signal is also coupled directly to the hammer movement control circuit 43 to cause the pulse motor to be returned to an original position.

Figure 3:
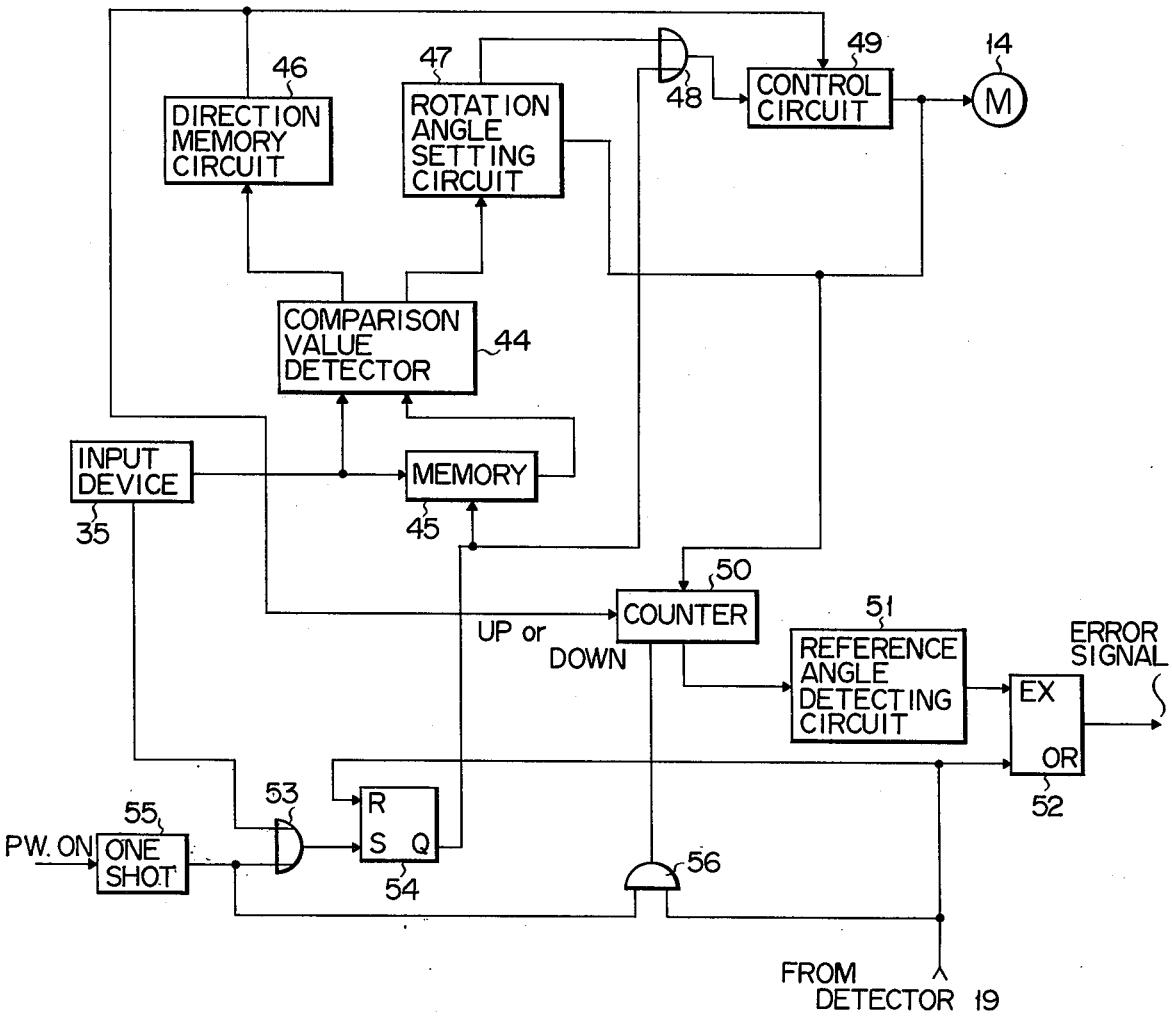
FIG. 3 is a block circuit diagram of a circuit according to another embodiment of the invention for confirming correct impression through control of the rotation of a printing drum.

FIG. 3 shows a control circuit for printing character confirmation. The input device 35 generates an output signal corresponding to the rotation angle position of a character on the printing drum 11 which is to be inputted. The rotation angle position signal consists of each of numerical data corresponding to rotation angle sequence numbers arranged at a predetermined rotation angle on the outer periphery of the printing drum 11. The numerical data is supplied to a comparison value detector 44 and memory circuit 45. The memory circuit 45 is adapted to store a numerical data corresponding to the now inputted character signal and deliver a numerical data corresponding to a character stored immediately before a character signal is now inputted. The output numerical data of the memory circuit 45 is supplied to the comparison value detector 44 where it is compared with a numerical data corresponding to the now inputted character signal. That is, the comparison value detector 44 is adapted to compare a numerical values the rotation angle position of the printing drum 11 when the character signal is now inputted and the rotation angle position of the printing drum 11 in which the character corresponding to the now inputted character signal is located on the printing drum 11, and calculate based on the direction of rotation of the printing drum 11 a rotation angle at which the printing drum 11 is rotated from the present position to a position in which a character on the printing drum 11 corresponding to the character signal confronts the hammer 26. The direction and rotation angle of the printing drum 11 are stored in a direction memory circuit 46 and a rotation angle counter 47, respectively. The number of steps corresponding to the angle position of the printing drum 11 is preset in the rotation angle counter 47. When any numerical value representing the number of steps is present in the rotation angle counter 47, the rotation angle counter 47 generates a number presence signal. The output of the rotation angle counter 47 is coupled through an OR circuit 48 to a control circuit 49. A direction signal of the direction memory circuit 46 is also coupled to the control circuit 49. While the number presence signal is present in the rotation angle counter 47, the pulse motor 14 is moved stepwise in a direction corresponding to the direction signal and the step drive signal of the control circuit 49 gives a count down instruction [−1] to the rotation angle counter 47. That is, the pulse motor 14 is moved stepwise while the rotation angle counter 47 is being counted down. The pulse motor 14 is rotated stepwise until the numerical value of the rotation angle circuit 47 becomes zero, i.e., the number presence signal of the angular rotation counter 47 ceases to exist. In this way, the printing drum 11 is rotated stepwise so that the character on the printing drum 11 corresponding to the character signal confronts the hammer 26. As a result, a desired rotation angle position is set.

The step drive signal coupled from the control circuit 49 to the pulse motor 14 is supplied as a count step signal to a counter 50 capable effecting an up-down counter 50 and having the number of counts corresponding to the number of characters on the outer periphery of the printing drum 11. The counter 50 is given a count up instruction or a count down instruction which is supplied from the direction memory circuit 46. When the printing drum 11 is rotated stepwise upon receipt of the rotation drive instruction, the counter 50 sequentially and cumulatively counts and stores a value corresponding to the rotation angle of the printing drum 11 at that time. The count value of the counter 60 is monitored at a reference angle detecting circuit 51 and the reference angle detecting circuit 51 generates a detection signal when a count value appears which corresponds to the rotation angle of the printing drum 11 when a detection signal is obtained at the reference angle detector 19 as shown in FIG. 1. The detection signal of the reference angle detecting circuit 51 is supplied to an exclusive OR circuit 52 and the detection signal from the reference angle detector 19 is also coupled to the exclusive OR circuit 52. The exclusive OR circuit 52 generates an error signal when the detection signal from the reference angle detecting circuit 51 and the detection signal from the reference angle detector 51 do not simultaneously occur. That is, the output of the control circuit 49 is coupled to the counter 50, the output of which is coupled, together with the reference angle detection signal of the reference angle detector 19, to the exclusive OR circuit 51 for comparison. When the printing drum 11 is correctly controlled according to the control signal for driving the printing drum 11, no error signal is delivered from the exclusive OR circuit 52, since the printing drum 11 is so angularly controlled that a character on the printing drum 11 corresponding to the character signal from the input device 35 confronts the hammer 26. When, for example, a slippage occurs during the mechanical rotation control of the printing drum 11 or when an input character signal does not coincide with a character on the printing drum 11 corresponding to the input character signal due to a signal mutilation, interference from noise signals and so on, the detection signal of the reference angle detector 19 and the detection signal of the reference angle detecting circuit 51 are not synchronized with each other, an error signal is delivered from the exclusive OR circuit 52 and in this case it is only necessary that an alarm device be driven for alarm.

When a return instruction is issued from the input device 35, a corresponding return signal is coupled as a set signal to a flip-flop 54 through an OR circuit 53 to cause the flip-flop 54 to be set. With the flip-flop 54 in the set state a preset instruction corresponding to the reference angle is supplied to the memory circuit 45 to cause the memory content to be cleared and at the same time a drive instruction is sent through the OR circuit 48 to the control circuit 49, the output of which causes the pulse motor 14 to be continuously rotated. The rotation of the pulse motor 14 is continued until the flip-flop circuit 54 is reset by a reference angle detection signal from the reference angle detector 19, and the printing drum 11 is stopped at the reference angle position. At this time, the count value of the counter 50 is detected at the reference angle detection circuit 51 and the detection output of the reference angle detection circuit 51 is coupled to the exclusive OR circuit 52 where a judgement is made as to whether or not the correct rotation angle control of the printing drum is effected for correct printing. That is, each time the return movement is at least effected, comparison is made between the number of rotation steps required for the printing drum 11 to be returned to the reference rotation angle position and the number of steps corresponding to a character on the printing drum 11 which is finally printed in a line on the recording paper. As a result of comparison, the rotation angle position of the printing drum 11 is correctly checked and in consequence whether or not the character on the printing drum 11 is correctly selected is monitored.

When the printing apparatus is started, a start signal is coupled through a one-shot circuit 55 and OR circuit 53 to a flip-flop circuit 54. The set output of the filp-flop circuit 54 causes the memory circuit 45 to be preset in readiness for a printing operation. In this case, the output signal of the one-shot circuit 55 and the reference signal of the reference angle detector 19 are supplied to an AND circuit 56 to cause the counter 50 to be preset to a numerical value corresponding to the reference angle. Then, the count value of the counter 50 and the rotation angle position of the printing drum 11 corresponds to each other to permit a correct printing operation.

Although the character group on the outer periphery of the printing drum 11 is correctly selected by the rotation angle control of the printing drum 11, a correct character selection of the row character is also confirmed by the axial movement control of the printing drum 11. This embodiment will now be described below.

Figure 4:
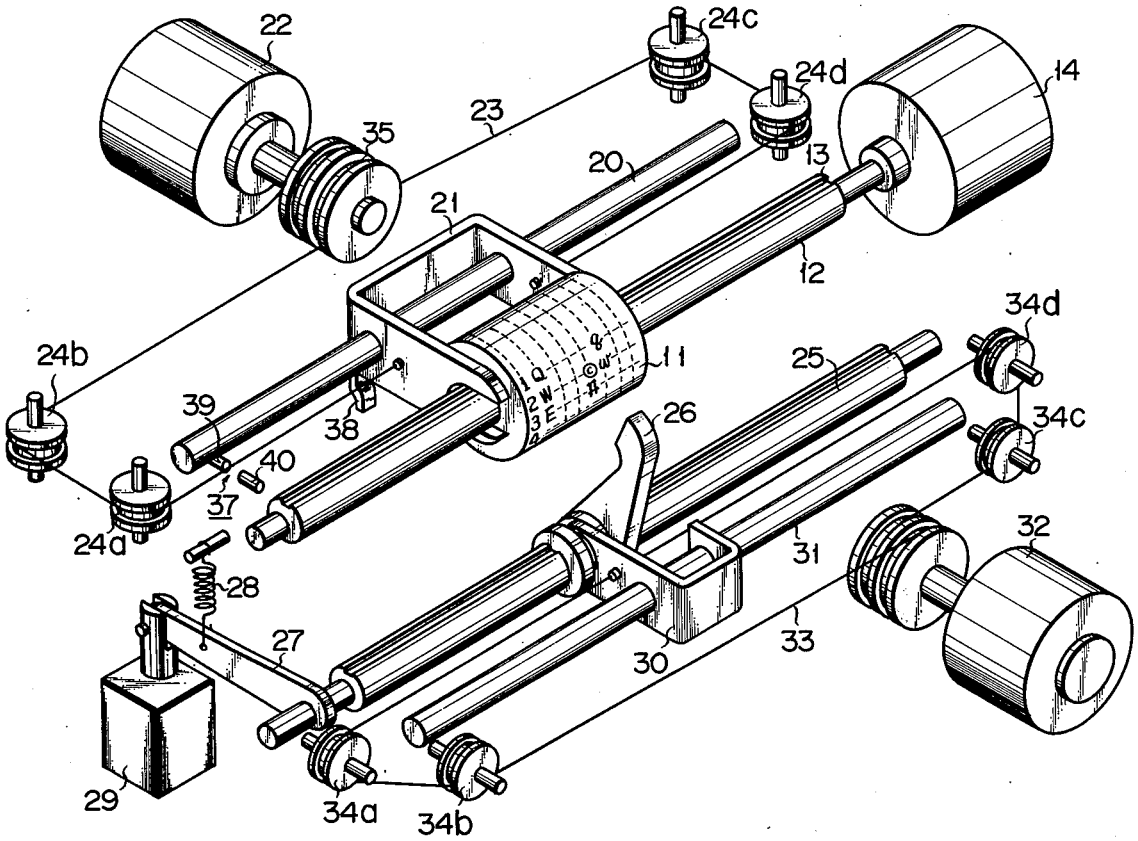
FIG. 4 is an oblique view of the main part of a printing device provided with an apparatus according to still another embodiment of the invention for confirming correct impression of printing characters.

FIG. 4 shows a printing apparatus equipped with a reference axial position detector 37 for detecting a reference axial position to which a printing drum 11 is moved. The printing apparatus in FIG. 4 is the same as that in FIG. 1 except that the reference axial position detector 37 is provided. Therefore, further explanation is omitted for brevity sake. A shielding plate 38 is mounted on the bottom of a holder 21. At one end portion of the guide rail 20 a light source 39 and light receiving element 40 are provided in alignment with each other so that the shielding plate 38 is moved for light shielding between the light source 39 and the light receiving element 40.

Figure 5:
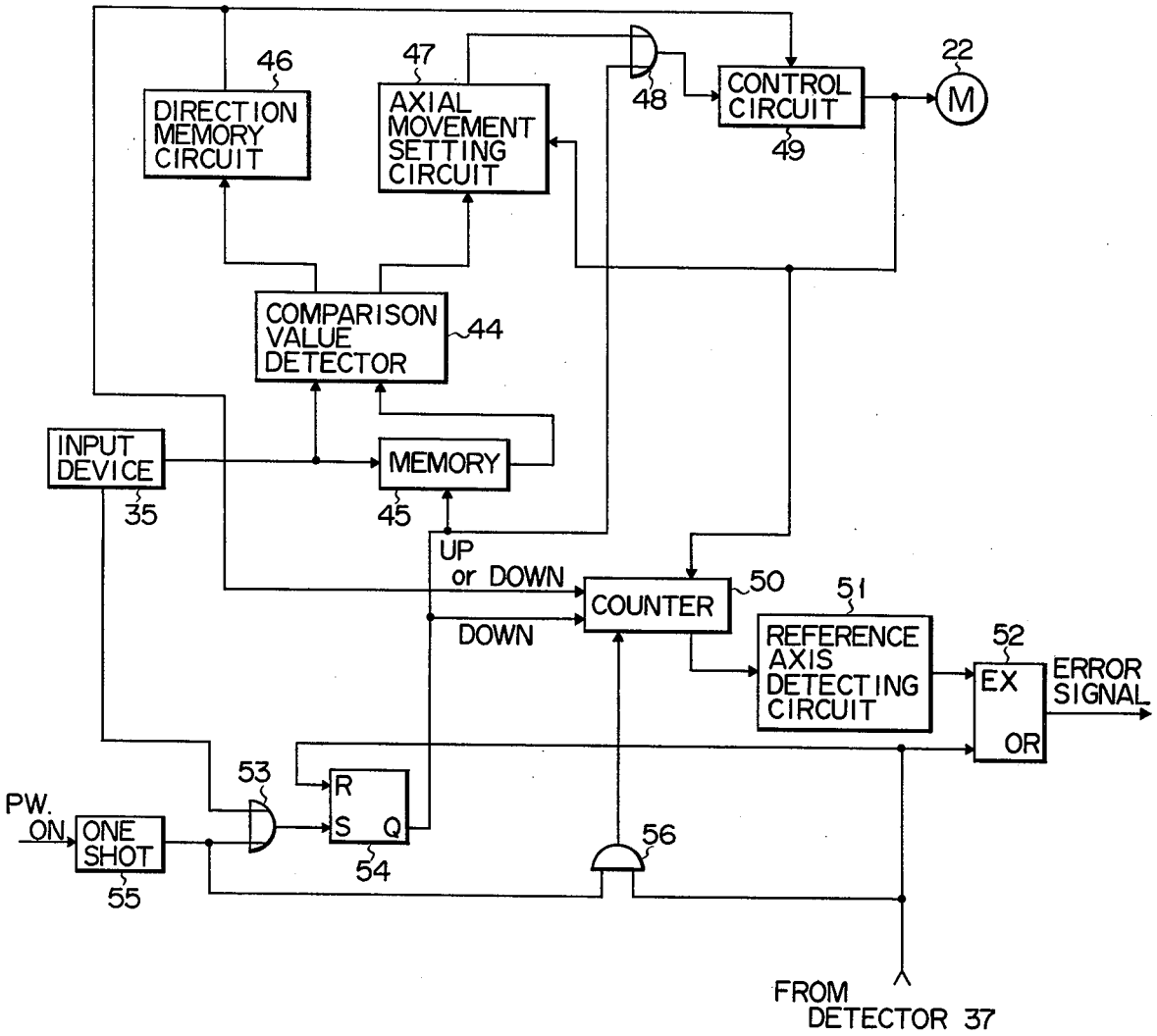
FIG. 5 is a block circuit diagram of a circuit according to still another embodiment of the invention for confirming correct impression through control of the axial movement of the printing drum.

FIG. 5 shows a drive control circuit of the printing apparatus, and in particular an axial movement control section of the printing drum 11. When the input device 35 is operated, a character row data on the outer periphery of the printing drum 11, i.e., the axial movement position designating data is obtained. The axial position designating data is supplied to a comparison value detector 44 and memory circuit 45. The memory circuit 55 stores a preceding axial position designating data and when a new axial position designating data is written into the memory circuit 45 the preceding axial position data is delivered to the comparison value detecting circuit 44. As a result, the new axial position designating data and preceding axial position designating data are compared at the comparison value detector 44 where an axial moving amount and axial direction which are necessary for a hammer 25 to confront the character row is detected. The outputs of the comparison value detector 44 are coupled to an axial direction memory circuit 46 and an axial movement setting circuit 47 consisting of a counter. The axial direction memory circuit 46 designates based on a plus or minus a direction in which the printing drum 11 is axially moved.

The axial movement setting circuit 47 counts count values corresponding to axial movement of the printing drum 11 and when a count value is present in the axial movement setting circuit 47 the axial movement setting circuit 47 delivers an output. The output of the axial movement setting circuit 47 is coupled as a drive instruction to a control circuits 49 through an OR circuit 48. The direction instruction data of the direction memory circuit 46 is also coupled to the control circuit 49. When the drive instruction data is present, a pulse motor 22 is axially moved stepwise according to the designated direction and at the same time the step drive signal of the control circuit 51 is also supplied as a count down instruction signal [−1] to the axial movement setting circuit 47. That is, the axial movement counting circuit 47 is counted down for each step movement of the pulse motor 22 and thus the printing drum 11. When the printing drum 11 is moved to a position where a predetermined character on the printing drum 11 confronts the hammer 25, the count value of the axial movement setting circuit 47 becomes zero. That is, the output of the axial movement setting circuit ceases to exist, causing the rotation of the pulse motor 22 to be stopped.

The step drive signal of the control circuit 44 is coupled as a step signal to the counter 50. The counter 50 is counted up or down according to a direction instruction data from the direction memory circuit 46 and the counter 50 can set the axial movement position of the printing drum 11 in terms of numeral values according to the axial movement instruction data of the control circuit 51. When the count value of the counter 50 becomes a count value corresponding to the reference axial movement position of the printing drum 11, a delection signal is delivered to an exclusive OR circuit 52. The output of the reference axial position detector 37 is also coupled to the exclusive OR circuit 52. When either one of the output of the axial movement detecting circuit 51 and the output of the reference axial movement position detector 37 is coupled to the exclusive OR circuit, an error signal is delivered, for example, to an alarm device for alarm.

In this embodiment, a return instruction of the input device 35 is supplied as a set instruction signal to a flip-flop circuit 54 through an OR circuit 54. The output of a one-shot circuit 55 is also coupled to the OR circuit 54 when a power source is rendered ON. The set output of the flip-flop circuit 54 is coupled through the OR circuit 48 to the pulse motor 22 to cause the pulse motor 22 to be driven in a return direction. The set output of the flip-flop circuit 54 is also coupled to the memory circuit 45 to cause the latter to be preset to a return complete position. The return instruction output signal of the control circuit 49 is also coupled as a step instruction signal to the counter 50. At this time, the set output of the flip-flop circuit 54 is also coupled as a count down instruction signal to the counter 50 to cause the latter to be counter down. When the printing drum 11 is returned to a reference axial position, the reference axial position detector 37 delivers a detection output signal. The output of the reference axial position detector 37 is coupled to a flip-flop circuit 54 to cause the latter to be reset, thus stopping the return movement of the printing drum 11. The output of the reference axial position detector 37 is also coupled together with the output of the one-shot circuit 55 to the AND circuit 56. The output of the AND circuit 56 is applied to the counter 50 to cause the counter 50 to be preset to a count value corresponding to the reference axial position of the printing drum 11.

The pulse motor 22 is driven according to a character signal from the input device 35, setting the axial position of the printing drum 11 to cause the character row on the outer periphery of the printing drum 11 to confront the hammer 26 and correctly printing a character on the outer periphery of the printing drum 11 according to the character signal of the input device 35. The axial movement position of the printing drum 11 is always stored in the form of count values in the counter 50. When a return instruction is issued, the printing drum 11 is returned to the reference axial position, i.e., the head character position and the amount of return movement is also counted at the counter 50.

When the printing drum 11 is correctly axially controlled by the instruction output of the control circuit 49 for correct selection of the character row, the detection output of the reference axial position detector 37 and detection output of the reference axial position detecting circuit 51 simultaneously occur and in consequence no error signal is generated from the exclusive OR circuit 52. When, however, any erroneous operation is effected for some reason or other between the control circuit 49 and the pulse motor 19 or at the printing drum moving mechanism, and in consequence a character row position on the outer periphery of the printing drum 11 does not confront the hammer 26, the detection output of the reference axial position detector 37 and detection output of the reference axial position detecting circuit 51 do not simultaneously occur and the exclusive OR circuit 52 delivers an error signal. In this way, the character row of the printing drum is correctly selected for each return operation and a confirmation is made as to whether or not a current printing operation is effected.

In the above-mentioned embodiment the reference axial position detector 37 is set to a return complete position and the predetermined count value of the reference axial position detecting circuit 51 is made to correspond to the return complete position. In this case, a correct printing operation is confirmed at the return of the printing drum 11. The confirmation position can be set to any position in a range of movement of the printing drum 11. If the confirmation position is set midway in a range of movement of the printing drum 11, a correct printing operation is confirmed each time the printing drum 11 reaches the confirmation position. Added results are obtained if a plurality of position detectors are provided. In this case, a corresponding number of reference axial position detector are provided for comparison.

This invention can be changed in a variety of ways without departing from the spirit and scope of this invention.

What is claimed is:

1. Apparatus for confirming a correct impression of printing characters in which the rotation angle of an axially movable, stepwise rotatable, printing drum on the outer surface of which at least one group of characters is arranged is so controlled that a designated character on the outer surface of the printing drum confronts a predetermined printing position on a recording medium for printing, said apparatus comprising:

first means for defining at least one rotational reference angle position of the printing drum at a given reference angle;

second means for designating the number of rotation steps required to cause a desired character on the outer periphery of the printing drum corresponding to a distance from said reference angle position of the printing drum to confront the recording medium;

third means for storing the number of said designated rotation steps;

fourth means for detecting a difference between the number of rotation steps stored in said third means and the number of rotation steps corresponding to that distance from said reference angle position of said rotating drum where a character to be next printed is located on the outer periphery of the printing drum;

fifth means coupled to said printing drum for effecting printing according to the detection output of said fourth means through a cummulative control of the rotation angle of said printing drum while sequentially and axially moving the printing drum;

sixth means for returning said printing drum to said reference angle position after printing is completed in a line on the recording medium; and seventh means for checking a printing error for each line on the recording medium by comparing the number of rotation steps required for the printing drum to be returned to said reference angle position and the number of rotation steps corresponding to a distance from said reference angle position to that position at which the last character is to be printed in each line on the recording medium.

2. Apparatus according to claim 1 in which said seventh means comprises:

a counter for counting the number of steps required for the printing drum to be returned to said reference angle position, detecting means for detecting a predetermined count value counted by said counter, and a logic circuit for detecting a coincidence or a non-coincidence between the detection output of said detecting means and an output corresponding to said distance from said reference angle position to the position at which the last character is to be printed in each line on the recording medium.

3. Apparatus according to claim 2 in which said counter is preset to a predetermined count value when a power source is rendered ON and the printing drum is returned to said reference angle position when the power source is rendered ON.

4. Apparatus according to claim 1, further including:

means for stepwise moving said printing drum in its axial direction, means for selecting the character on the printing drum by designating a character row position as measured from an axial reference printing position, storing means for storing said character row position, means for sequentially selectively controlling the character row position on the printing drum by comparing the number of steps stored in said storing means with a character row position to be next printed and detecting a left or right axial direction designation and the designated character position, means for returning the printing drum to said axial reference position upon completion of printing in each line on the record medium, and means for checking a printing error in the axial direction by comparing the number of steps required for the printing drum to be returned to said axial reference position with the number of steps corresponding to the number of character rows attained by completion of each line of printing.

5. Apparatus according to claim 4 in which said means for checking the printing error operation comprises:

a counter for counting the number of steps required for the printing drum to be returned to said axial reference position, detection means for detecting a signal corresponding to a particular count value from the counter, and a logic circuit for detecting a coincidence or a non-coincidence between the detection output of the detection means and an output representative of the number of steps corresponding to a distance from the axial reference position to the position at which the last character is to be printed in each line on the recording medium.

6. Apparatus according to claim 5 in which said counter is preset to a predetermined count value when a power source is rendered ON and said printing drum is returned to its original axial position when the power source is rendered ON.

* * * * *